US010805733B2

(12) United States Patent
Sun et al.

(10) Patent No.: US 10,805,733 B2
(45) Date of Patent: Oct. 13, 2020

(54) LOUDSPEAKER-PURPOSE VIBRATING CONE AND LOUDSPEAKER

(71) Applicant: Harman International Industries, Incorporated, Stamford, CT (US)

(72) Inventors: Kaifeng Sun, Suzhou (CN); Xipeng Ye, Suzhou (CN); Na Liu, Suzhou (CN); Yi Chen, Suzhou (CN)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/443,979

(22) Filed: Jun. 18, 2019

(65) Prior Publication Data

US 2020/0007990 A1 Jan. 2, 2020

(30) Foreign Application Priority Data

Jun. 29, 2018 (CN) ..... 2018 2 1018024 U

(51) Int. Cl.
*H04R 9/02* (2006.01)
*H04R 1/02* (2006.01)
*H04R 7/04* (2006.01)

(52) U.S. Cl.
CPC ..... *H04R 9/025* (2013.01); *H04R 1/025* (2013.01); *H04R 7/04* (2013.01)

(58) Field of Classification Search
CPC ..... H04R 7/125; H04R 1/025; H04R 9/025; H04R 7/04; H04R 7/12; H04R 7/26; H04R 2307/021
USPC ..... 381/412, 424, 353, 354, 432; 181/164, 181/166, 167, 170
See application file for complete search history.

(56) References Cited

U.S. PATENT DOCUMENTS

2003/0185416 A1* 10/2003 Sugiura ..... H04R 7/12 381/424
2004/0168851 A1 9/2004 Imamura et al.
2006/0147081 A1 7/2006 Mango et al.
2012/0148085 A1* 6/2012 Omori ..... H04R 7/14 381/400
2015/0310848 A1* 10/2015 Zhu ..... G10K 13/00 181/167
2016/0212540 A1* 7/2016 Shibuya ..... H04R 7/125

FOREIGN PATENT DOCUMENTS

JP S6482896 A 3/1989

* cited by examiner

*Primary Examiner* — Melur Ramakrishnaiah
(74) *Attorney, Agent, or Firm* — Angela M. Brunetti

(57) ABSTRACT

A loudspeaker and a vibrating cone for a loudspeaker wherein the vibrating, cone has a vibrating diaphragm arranged to be connected with a voice coil of the loudspeaker at a connecting position, the vibrating diaphragm comprises a first portion adjacent t the connecting position and a second portion spaced a distance from the connecting position. A strength of the first portion of the vibrating diaphragm is greater than a strength of the second portion of the vibrating diaphragm.

10 Claims, 4 Drawing Sheets

LOUDSPEAKER-PURPOSE VIBRATING CONE AND LOUDSPEAKER

CROSS-REFERENCE TO RELATED APPLICATIONS

This application claims priority to CN Application No. 201821018024.X, filed Jun. 29, 2018, the disclosure of which is incorporated, in its entirety, by reference herein.

TECHNICAL FIELD

The present disclosure relates to a loudspeaker-purpose vibrating cone and a loudspeaker. More specifically, the present disclosure relates to a partially-strengthened loudspeaker-purpose vibrating cone and a loudspeaker having such loudspeaker-purpose vibrating cone.

BACKGROUND

The vibrating cone is an important part for a loudspeaker, which is connected with a voice coil. When the loudspeaker works, the voice coil vibrates in a magnetic gap, driving the vibrating cone to vibrate to make a sound, in order to achieve good sound output, it is usually necessary to lighten the weight of the vibrating cone and minimize split vibration, especially at medium and high frequencies, at the same time.

There are various loudspeaker-purpose vibrating cones in the market, such as vibrating cones with a vibrating diaphragm formed from single or double diaphragm sheets. However, these vibrating cones fail to achieve the effects of lightening the weight of the vibrating cone and decreasing split vibration at the same time.

Therefore, there is a need for a vibrating cone that is light in weight and can decrease split vibration, especially at medium and high frequencies, at the same time.

SUMMARY

The inventive subject matter provides a vibrating cone that is light in weight and can decrease split vibration, especially at the medium and high frequencies, at the same time.

Split vibration may be effectively reduced by partially strengthening the vibrating diaphragm of the loudspeaker-purpose vibrating cone, specifically, strengthening a region, adjacent to the voice coil, of the vibrating diaphragm of the loudspeaker-purpose vibrating cone. Since the area of the strengthened region of the vibrating diaphragm is relatively small compared with the area of the entire vibrating diaphragm, the weight of the strengthened vibrating diaphragm does not increase much. Therefore, the vibrating cone is light in weight and can effectively decrease split vibration, especially at medium and high frequencies, at the same time.

According to one or more embodiments, a loudspeaker-purpose vibrating cone is provided. The loudspeaker-purpose vibrating cone comprises a vibrating diaphragm arranged to be connected with a voice coil of the loudspeaker at a connecting position, the vibrating diaphragm comprises a first portion adjacent to the connecting position and a second portion, spaced a distance, far away, from the connecting position, and the strength of the first portion of the vibrating diaphragm is greater than the strength of the second portion of the vibrating diaphragm.

Optionally, the vibrating diaphragm is arranged to be connected with the voice coil of the loudspeaker at a radially inner end of the vibrating diaphragm, the first portion of the vibrating diaphragm is a radially inner portion of the vibrating diaphragm, and the second portion of the vibrating diaphragm is a radially outer portion of the vibrating diaphragm.

Optionally, the radial size of the first portion of the vibrating diaphragm is smaller than half of the radial size of the entire vibrating diaphragm, and the radial size of die second portion of the vibrating diaphragm is greater than half of the radial size of the entire vibrating diaphragm.

Optionally, the loudspeaker-purpose vibrating cone is circular or racetrack-shaped, and comprises a folding ring connected with the vibrating diaphragm at a position far away from the connecting position.

Optionally, the vibrating diaphragm comprises a first diaphragm sheet and a second diaphragm sheet, the first diaphragm sheet comprises a first diaphragm sheet portion and a second diaphragm sheet portion, the first diaphragm sheet portion forms the first portion of the vibrating diaphragm, and the second diaphragm sheet is connected to the second diaphragm sheet portion to form the second portion of the vibrating diaphragm together with the second diaphragm sheet portion.

Optionally, the second diaphragm sheet is bonded to the second diaphragm sheet portion of the first diaphragm sheet.

Optionally, the first diaphragm sheet and the second diaphragm sheet are formed from aluminum, paper or titanium.

Optionally, the vibrating diaphragm, the first diaphragm sheet, and the second diaphragm sheet are all in a truncated cone shape.

Optionally, the vibrating diaphragm and the first diaphragm sheet are both in a truncated cone shape, and the second diaphragm sheet comprises a bottom in a truncated cone shape and a plurality of petal portions extending from the bottom of the second diaphragm sheet.

Optionally, the vibrating diaphragm and the first diaphragm sheet are both in a truncated cone shape, and the second diaphragm sheet comprises a hollowed-out truncated cone shape.

Optionally, the vibrating diaphragm is an integrally-formed diaphragm sheet.

Optionally, the thickness of the first portion of the vibrating diaphragm is greater than that of the second portion of the vibrating diaphragm.

According to another aspect of the inventive subject matter, a loudspeaker is provided. The loudspeaker comprises: a magnet structure, the magnet structure forming a magnetic gap; a voice coil, a portion of the voice coil being suspended in the magnetic gap; and the loudspeaker-purpose vibrating cone according to preceding clauses, the vibrating diaphragm of the loudspeaker-purpose vibrating cone being connected with the voice coil.

DETAILED DESCRIPTION

Figure 1:
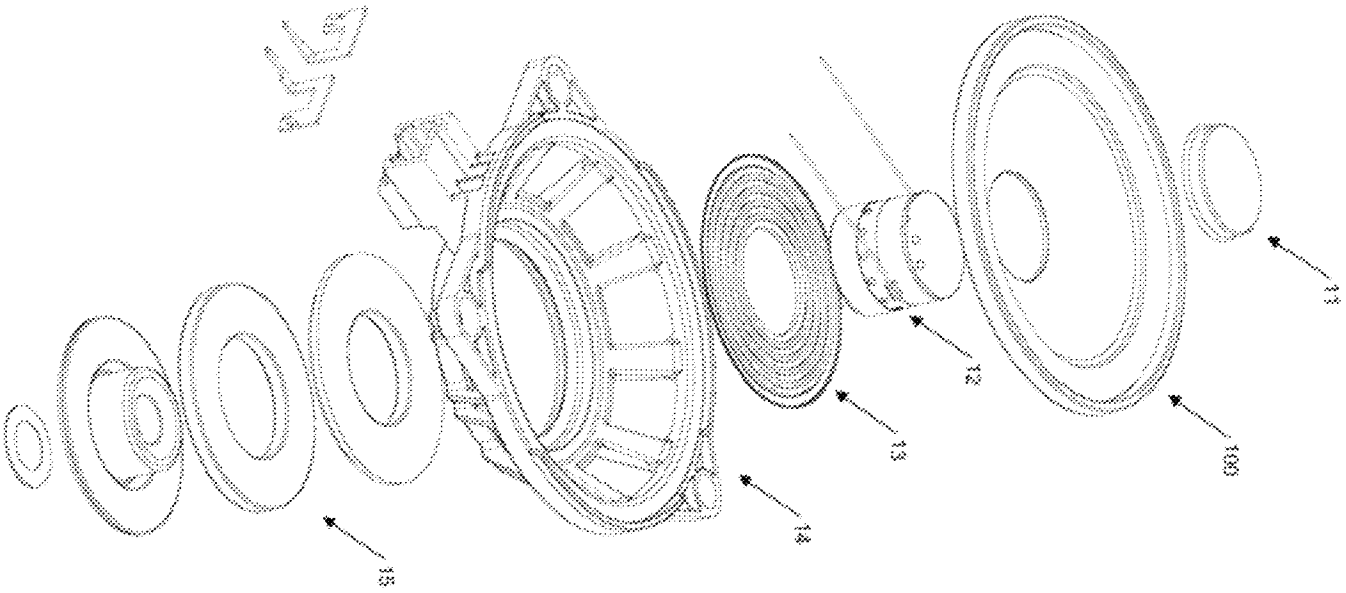
FIG. 1 is an exploded view of a loudspeaker according to one or more embodiments.

Embodiments will be described below in detail, and examples of the embodiments are illustrated in the drawings, in which identical or similar reference signs always represent identical or similar elements or elements having identical or similar functions. The embodiments described below by referring to the drawings are exemplary and can only be used to explain the inventive subject matter instead of being understood as limitations to the inventive subject matter.

Unless otherwise defined, the technical terms or scientific terms used herein shall be general meanings that could be understood by those with general skills in the field of the inventive subject matter. In the description of the inventive subject matter, it needs to be understood that the direction or position relationships indicated by the terms such as "center", "longitudinal", "transverse", "up", "down", "front", "back", "left", "right", "vertical", "horizontal", "top", "bottom", "inside" and "outside" are based OD the direction or position relationships illustrated in the drawings and used for the purpose of conveniently describing the inventive subject matter and simplifying the description rather than indicating or implying that the referred device or element must has a specific orientation and be constructed and operated in a specific orientation, and thus cannot be understood as the limitations to the inventive subject matter. In addition, the terms "first" and "second" are used only for the purpose of description, instead of being understood as indicating or implying relative importance.

Figure 2:
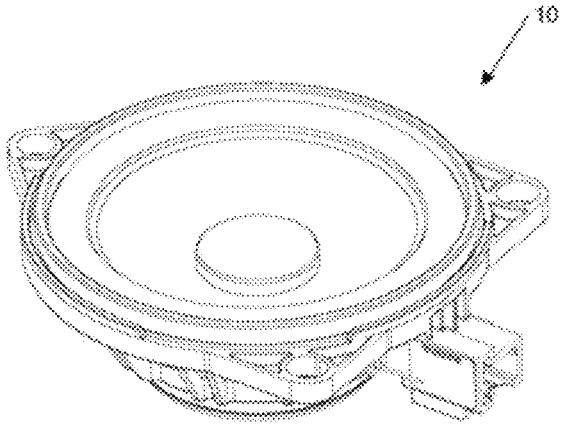
FIG. 2 is an assembly view of the loudspeaker illustrated in FIG. 1.

FIG. 1 and FIG. 2 illustrate a loudspeaker 10 according to one or more embodiments, wherein FIG. 1 is an exploded view of the loudspeaker 10, and FIG. 2 is an assembly view of the loudspeaker 10. As illustrated in FIG. 1 and FIG. 2, the loudspeaker 10 comprises a dust cover 11, a vibrating cone 100, a voice coil 12, a damper 13, a cone frame 14, and a magnet structure 15. The magnet structure 15 forms a magnetic gap in which a lower end of the voice coil 12 is suspended. A radially inner end (lower end) of a vibrating diaphragm of the vibrating cone 100 is connected with an upper end of the voice coil 12. When the loudspeaker 100 works, the current the lower-end coil of the voice coil 12 makes the lower-end coil vibrate up and down in the magnetic gap, thus driving the entire voice coil 12 to vibrate and thereby driving the vibrating cone 100 to vibrate to make a sound.

Figure 3:
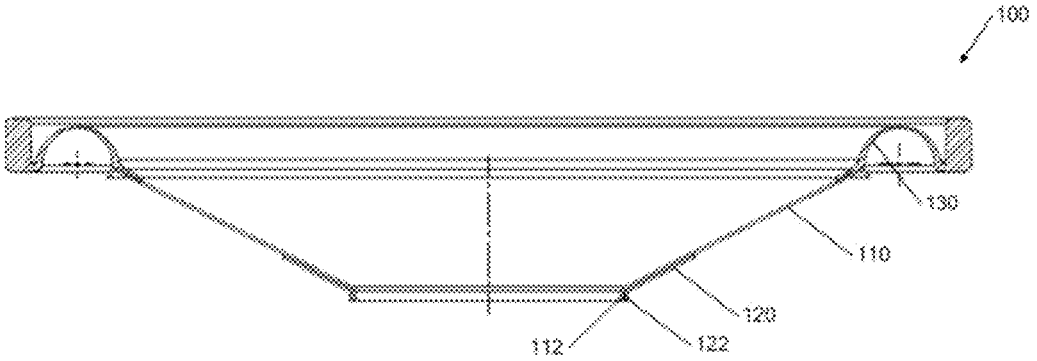
FIG. 3 is a sectional view of a vibrating cone according to one or more embodiments, wherein the vibrating cone may be used for the loudspeaker illustrated in FIG. 1.
Figure 4:
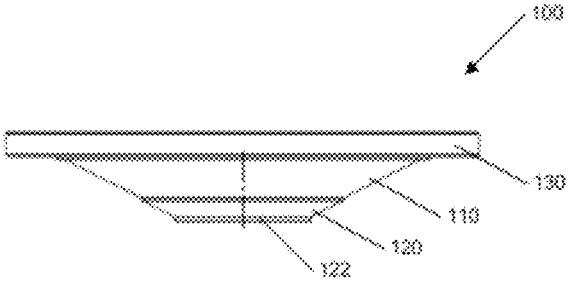
FIG. 4 is a front view of the vibrating cone illustrated in FIG. 3.
Figure 5:
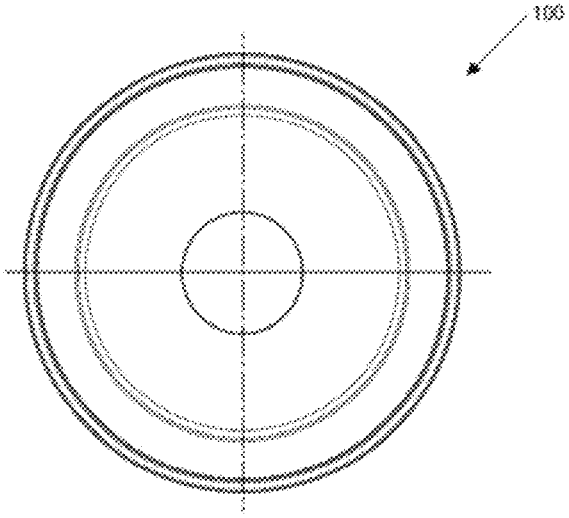
FIG. 5 is a top view of the vibrating cone illustrated in FIG. 3.
Figure 6:
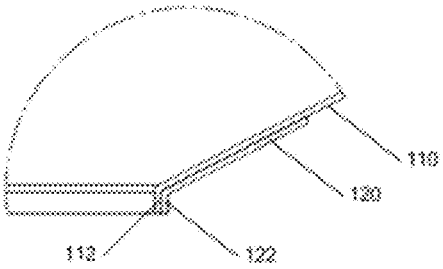
FIG. 6 is a partially enlarged view of the vibrating cone illustrated in FIG. 3.

FIGS. 3-6 illustrate a loudspeaker-purpose vibrating cone 100 according to one or more embodiments, wherein FIG. 3 is a cross-sectional view of the vibrating cone 100, FIG. 4 is a front view of the vibrating cone 100, FIG. 5 is a top view of the vibrating cone 100, and FIG. 6 is a partially enlarged view of the vibrating cone 100. As illustrated in the drawings, the vibrating cone 100 comprises a vibrating diaphragm and a folding ring 130. The vibrating, diaphragm of the vibrating cone 100 is generally in a truncated cone shape, and its radially inner end (lower end) forms a joint for connecting with the voice coil 12. The joint is generally cylindrical, and its axial length is much less than that of the truncated cone shape. The vibrating diaphragm is connected to the voice coil 12 at the joint. The vibrating diaphragm of the vibrating cone 100 comprises a first diaphragm sheet 110 and a second diaphragm sheet 120 bonded to the first diaphragm sheet 110. The first diaphragm sheet 110 extends over the range of the entire vibrating diaphragm, while the second diaphragm sheet 120 is only distributed in a lower region of the vibrating diaphragm. The first diaphragm sheet 110 and the second diaphragm sheet 120 are both generally in a truncated cone shape. The lower end 112 of the first diaphragm sheet 110 and the lower end 122 of the second diaphragm sheet 120 are bonded together to form the above-described joint. A portion, bonded to the second diaphragm sheet 120, of the first diaphragm sheet 110 may be called as a second diaphragm sheet portion, and the rest portion of the first diaphragm sheet 110 may be called as a first diaphragm sheet portion. As illustrated in the drawings and described above, the second diaphragm sheet 110 is distributed at and near a position where the vibrating diaphragm connects with the voice coil 12, thus reinforcing the strength of the vibrating diaphragm at and near the position where the vibrating diaphragm connects with the voice coil 12. The problem of split vibration of the vibrating cone 100 may be effectively improved by strengthening the vibrating diaphragm at and near the position where the vibrating diaphragm connects with the voice coil 12, without the need for strengthening the vibrating diaphragm wholly. It could be understood by one of ordinary skill in the art that the second diaphragm sheet 120 occupies only a small part of the whole area of the entire vibrating diaphragm, so the second diaphragm sheet 120 can effectively improve the split vibration performance of the vibrating cone 100, and meanwhile the weight of the entire vibrating diaphragm increases slightly.

According to one or more embodiments, the radial size of the second diaphragm sheet 120 is smaller than ½ of the radial size of the entire vibrating diaphragm. In an alternative embodiment, the radial size of the second diaphragm sheet 120 may be ¼ or ⅓ of the radial size of the entire vibrating diaphragm, or any suitable value between ½ and ¼ or ⅓. The radial size here refers to a size between the radially outer end and the radially inner end of the truncated cone shape as illustrated in the cross-sectional view in FIG. 3.

Figure 7:
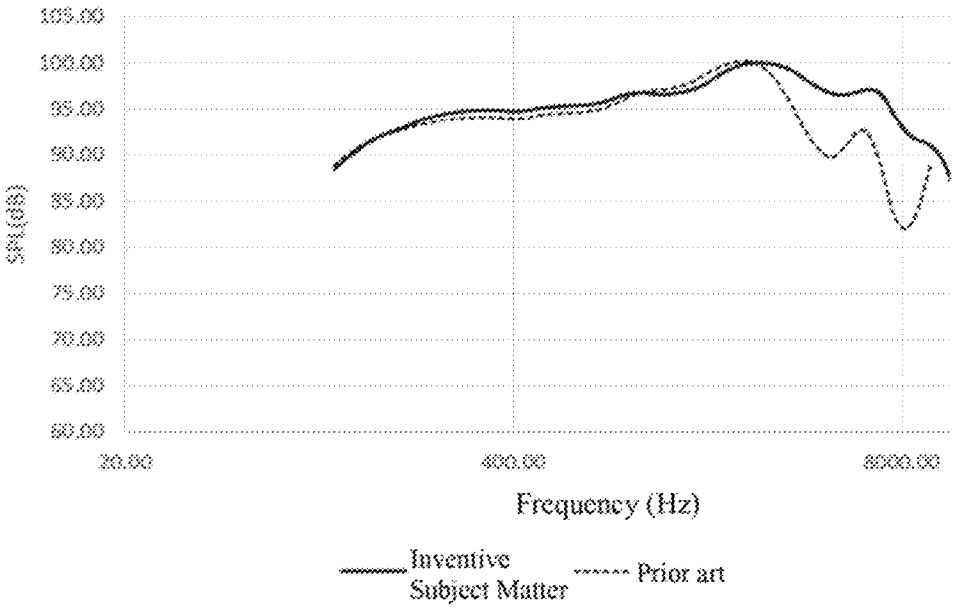
FIG. 7 is a comparison chart of Sound Pressure Levels (SPL) of the vibrating cone versus a vibrating cone of the prior art.

FIG. 7 is a comparison chart of test results of Sound Pressure Levels (SPL) of the vibrating cone in FIGS. 3-6 and a vibrating cone in the prior art. As can be seen from FIG. 7, the SPL of the vibrating cone is generally superior to that of the vibrating, cone in the prior art in the entire frequency range, especially in medium and high frequency ranges. That is to say, compared with the vibrating cone in the prior art, split vibration of the vibrating cone if the inventive subject matter in the medium and high frequency ranges is obviously decreased.

In the preferred embodiments illustrated in FIGS. 3-6, partial strengthening of the vibrating diaphragm is achieved by bonding the second diaphragm sheet 120 to the first diaphragm sheet 110. However, the inventive subject matter is not limited thereto. In an alternative embodiment, the vibrating diaphragm may be an integral component (a single diaphragm sheet) with a lower region having a greater strength than the other regions. For example, the material of the lower region of the vibrating diaphragm is different from that of the other region. The material of the lower region of the vibrating diaphragm has a greater strength; or the entire vibrating diaphragm uses the same material, but the lower region of the vibrating diaphragm has a greater thickness, or a combination of the two solutions is adopted.

It could be understood by one of ordinary skill in the art that in the preferred embodiments illustrated in FIGS. 3-6, the vibrating diaphragm has basically two strengths, i.e., in the upper region, the vibrating diaphragm consists of the single first diaphragm sheet 110 with a first strength, while in the lower region, the vibrating diaphragm is formed by the first diaphragm sheet 110 and the second diaphragm sheet 120 bonded together, and has a second strength greater than the first strength. The first diaphragm sheet 110 and the second diaphragm sheet 120 are both in a truncated cone shape. However, the inventive subject matter is not limited thereto. In alt alternative embodiment, at least one portion of the second diaphragm sheet 120 has a hollowed-out shape. In a further alternative embodiment, the second diaphragm sheet has a bottom in a generally truncated cone shape and a plurality of petal portions extending from the bottom. In this embodiment, the radial size of the bottom in a generally truncated cone shape is smaller than the radial size of the second diaphragm sheet 120 illustrated in FIGS. 3-6, and a sum of the radial sizes of the bottom and petal portions may be substantially the same as the radial size of the second diaphragm sheet 120 illustrated in FIGS. 3-6 or greater than the radial size of the second diaphragm sheet 120 illustrated in FIGS. 3-6. In an embodiment in which the vibrating diaphragm is an integral component, at least one portion of the vibrating diaphragm may have a gradually varying strength in the radially outward direction, e.g., the material strength of the vibrating diaphragm gradually changes in the radially outward direction, or the thickness of the vibrating diaphragm gradually changes in the radially outward direction.

In the preferred embodiments illustrated in FIGS. 3-6, the voice coil is connected to a lower end of the vibrating diaphragm, i.e., the radially inner end. However, the inventive subject matter is not limited thereto. In an alternative embodiment, the voice cod may be connected to an upper end of the vibrating diaphragm, i.e., the radially outer end.

Described above are just exemplary embodiments adopted for describing the principle of the inventive subject matter instead of limiting the protection scope of the inventive subject matter. For one of ordinary skill in the art, various modifications and improvements may be made without departing from the spirit and essence of the inventive subject matter, which, however, are also included in the protection scope of the inventive subject matter.

The invention claimed is:

1. A vibrating cone for a loudspeaker, comprising:

a vibrating diaphragm having an upper region and a lower region, the vibrating diaphragm connected to a voice coil of the loudspeaker at a connecting position;

a first diaphragm sheet having a truncated cone shape connected at a radially inner end of the vibrating diaphragm, the first diaphragm sheet has a predetermined strength;

a second diaphragm sheet less than half a radial size of the first diaphragm sheet, the second diaphragm sheet is bonded to the first diaphragm sheet beginning at a radially inner end of the vibrating diaphragm and defining a second predetermined strength that exceeds the first predetermined strength of the first diaphragm sheet;

the upper region of the vibrating diaphragm is defined by an area coinciding with the first diaphragm sheet having the first predetermined strength; and the lower region of the vibrating diaphragm is defined by an area coinciding with the first and second diaphragm sheets having the second predetermined strength.

2. The vibrating cone according to claim 1, wherein the loudspeaker-purpose vibrating cone is circular or racetrack-shaped, and has a folding ring connected with the vibrating diaphragm at a position spaced a distance from the connecting position.

3. The vibrating cone according to claim 1, wherein the first diaphragm sheet and the second diaphragm sheet are formed from aluminum, paper or titanium.

4. The vibrating cone according to claim 1, wherein the vibrating diaphragm, the first diaphragm sheet, and the second diaphragm sheet are all in a truncated cone shape.

5. The vibrating cone according to claim 1, wherein the vibrating diaphragm and the first diaphragm sheet are both in a truncated cone shape, and the second diaphragm sheet has a bottom in a truncated cone shape and a plurality of petal portions extending from the bottom of the second diaphragm sheet.

6. The vibrating cone according to claim 1, wherein the vibrating diaphragm and the first diaphragm sheet are both in a truncated cone shape, and the second diaphragm sheet has a hollowed-out truncated cone shape.

7. The vibrating cone according to claim 1, characterized in that the thickness of the first portion of the vibrating diaphragm is greater than that of the second portion of the vibrating diaphragm.

8. A loudspeaker, comprising:

a magnet structure forming a magnetic gap;

a voice coil, a portion of the voice coil being suspended in the magnetic gap; and a vibrating cone having a vibrating diaphragm having an upper region and a lower region, the vibrating diaphragm connected to the voice coil at a connecting portion and further comprising:

a first diaphragm sheet having a truncated cone shape connected at a radially inner end of the vibrating diaphragm, the first diaphragm sheet has a first predetermined strength;

a second diaphragm sheet less than half a radial size of the first diaphragm sheet, the second diaphragm sheet is bonded to the first diaphragm sheet beginning at a radially inner end of the vibrating diaphragm and defining a second predetermined strength that exceeds the first predetermined strength of the first diaphragm sheet;

the upper region of the vibrating diaphragm is defined by an area coinciding with the first diaphragm sheet having the first predetermined strength; and the lower region of the vibrating diaphragm is defined by an area coinciding with the first and second diaphragm sheets having the second predetermined strength.

9. The loudspeaker according to claim 8, wherein the vibrating cone is circular or race-track shaped, and has a folding ring connected with the vibrating diaphragm at a position spaced a distance from the connecting position.

10. The loudspeaker according to claim 8, wherein the thickness of the lower region of the vibrating diaphragm is greater than that of the upper region of the vibrating diaphragm.

* * * * *